United States Patent [19]

Hafner

[11] 3,934,327

[45] *Jan. 27, 1976

[54] METHOD OF INTERLOCKING OVERLAPPING SHEET MATERIAL

[76] Inventor: Otto P. Hafner, 1321 Paddock Way, Cherry Hill, N.J. 08034

[ * ] Notice: The portion of the term of this patent subsequent to May 27, 1992, has been disclaimed.

[22] Filed: Mar. 21, 1975

[21] Appl. No.: 560,786

Related U.S. Application Data

[60] Continuation-in-part of Ser. No. 497,884, Aug. 16, 1974, Pat. No. 3,885,299, which is a division of Ser. No. 384,494, Aug. 1, 1973, Pat. No. 3,862,485.

[52] U.S. Cl. ..... 29/432; 29/21.1; 29/200 B; 29/509; 29/521; 113/1 M; 113/116 FF

[51] Int. Cl.[2] ..... B23P 11/00; B23P 17/00

[58] Field of Search.... 29/432, 432.1, 432.2, 200 B, 29/200 R, 521, 208 D, 509, 522; 113/116 FF, 1 M; 403/282, 285

[56] References Cited

UNITED STATES PATENTS

| | | | |
|---|---|---|---|
| 2,254,558 | 9/1941 | Williams | 29/521 X |
| 2,671,361 | 3/1954 | Sandberg | 29/566 |
| 2,688,890 | 9/1954 | Williams | 113/116 FF X |
| 3,470,596 | 10/1969 | Belada | 29/521 X |
| 3,599,318 | 8/1971 | Behlen | 29/521 X |
| 3,726,000 | 4/1973 | Hafner | 29/521 X |

*Primary Examiner*—Victor A. DiPalma
*Attorney, Agent, or Firm*—Paul & Paul

[57] ABSTRACT

To fasten together two or more overlying sheets of metal or other material having plasticity or deformable properties by partially piercing and deforming minor areas of the sheets, a pierce-and-forming punch is used in cooperation with a double-acting press having two separately actuatable rams. For displacing the minor areas of the overlying sheets, one of the rams carries a hollow cylindrical pierce-and-forming die, the die cavity of which is vertically aligned with, and cooperates with, a pierce-and-forming punch supported in the base. The other of the rams carries a flattening punch which is slidably movable within the central bore of the hollow cylindrical die. Fine adjustment means are included so that the position of the die may be adjusted for different thickness of sheets to be fastened, and also for wear on the die and/or punch. Phase adjustment means are included which permits the angular relationship between the flattening punch and the die to be adjusted such that the downwardly-moving flattening punch engages the upper displaced minor area or areas just after the lower displaced minor area is uncovered by the upwardly-moving cylindrical die, thereby to spread the lower displaced minor area while the upper minor area or areas are still constrained. To reduce the extent to which the displaced minor areas project above the major areas of the sheets, the edge portions of the major areas adjacent the piercings or cuts are displaced downwardly.

2 Claims, 8 Drawing Figures

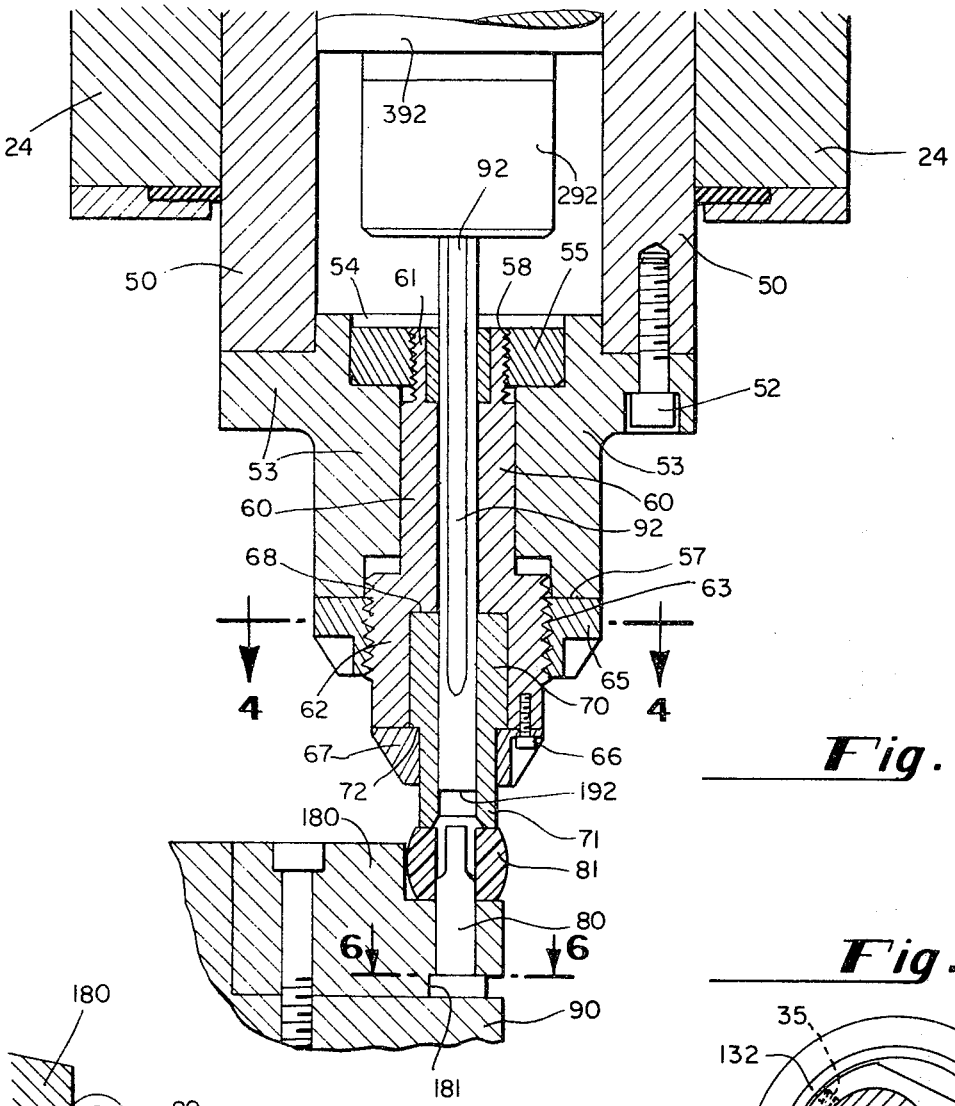
Fig. 3
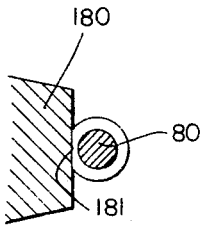
Fig. 6
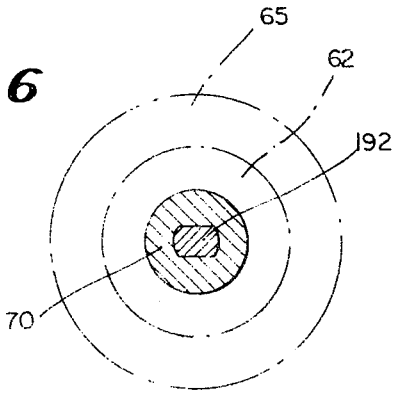
Fig. 4
Fig. 2
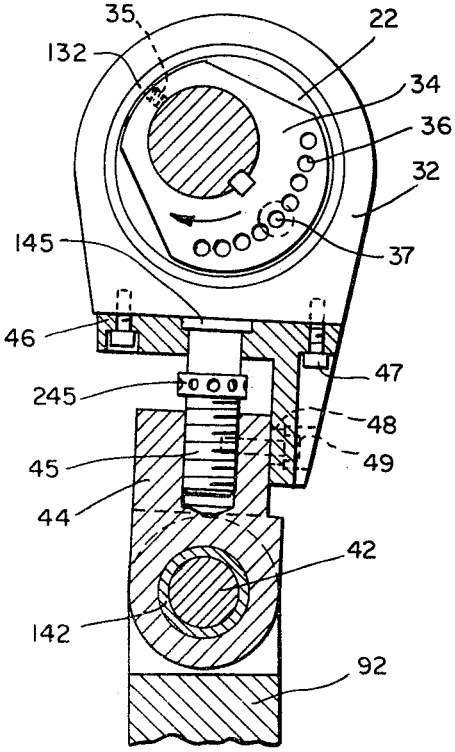

METHOD OF INTERLOCKING OVERLAPPING SHEET MATERIAL

CROSS-REFERENCE TO RELATED APPLICATIONS

This application is a continuation-in-part application of my earlier-filed application, Ser. No. 497,884, now U.S. Pat. No. 3,885,299, filed Aug. 16, 1974, which was a division of my application Ser. No. 384,494, filed Aug. 1, 1973, now U.S. Pat. No. 3,862,485, issued Jan. 28, 1975.

BACKGROUND OF THE INVENTION

This invention relates to a method of and means for fastening together two or more overlying sheets of deformable metal or other material having the property of yielding or flowing under load and of sustaining appreciable permanent deformation without rupture. In some instances there may be an intervening layer of film of another material between the sheets to be fastened.

SUMMARY OF THE INVENTION

An object of the present invention is to provide a method of and means for locking together overlying sheets of metal or other material having deformable properties by piercing the overlying sheets and displacing minor areas. To reduce the extent of the displacement, relative to the planes of the non-displaced major areas of the overlying sheets, the edge portions of the major areas immediately adjacent the piercings are turned in the opposite direction from the direction of displacement.

BRIEF DESCRIPTION OF THE DRAWINGS

FIG. 2 is a fragmentary view, largely in section, looking along the lines 2—2 of FIG. 1.

FIG. 3 is an enlarged framentary view, in section, of the lower portion of the structure shown in FIG. 1.

FIG. 4 is a view looking down along the line 4—4 of FIG. 3.

FIG. 6 is a view, in section, looking downwardly along the line 6—6 of FIG. 3.

DETAILED DESCRIPTION OF THE PREFERRED EMBODIMENTS

Figure 1:
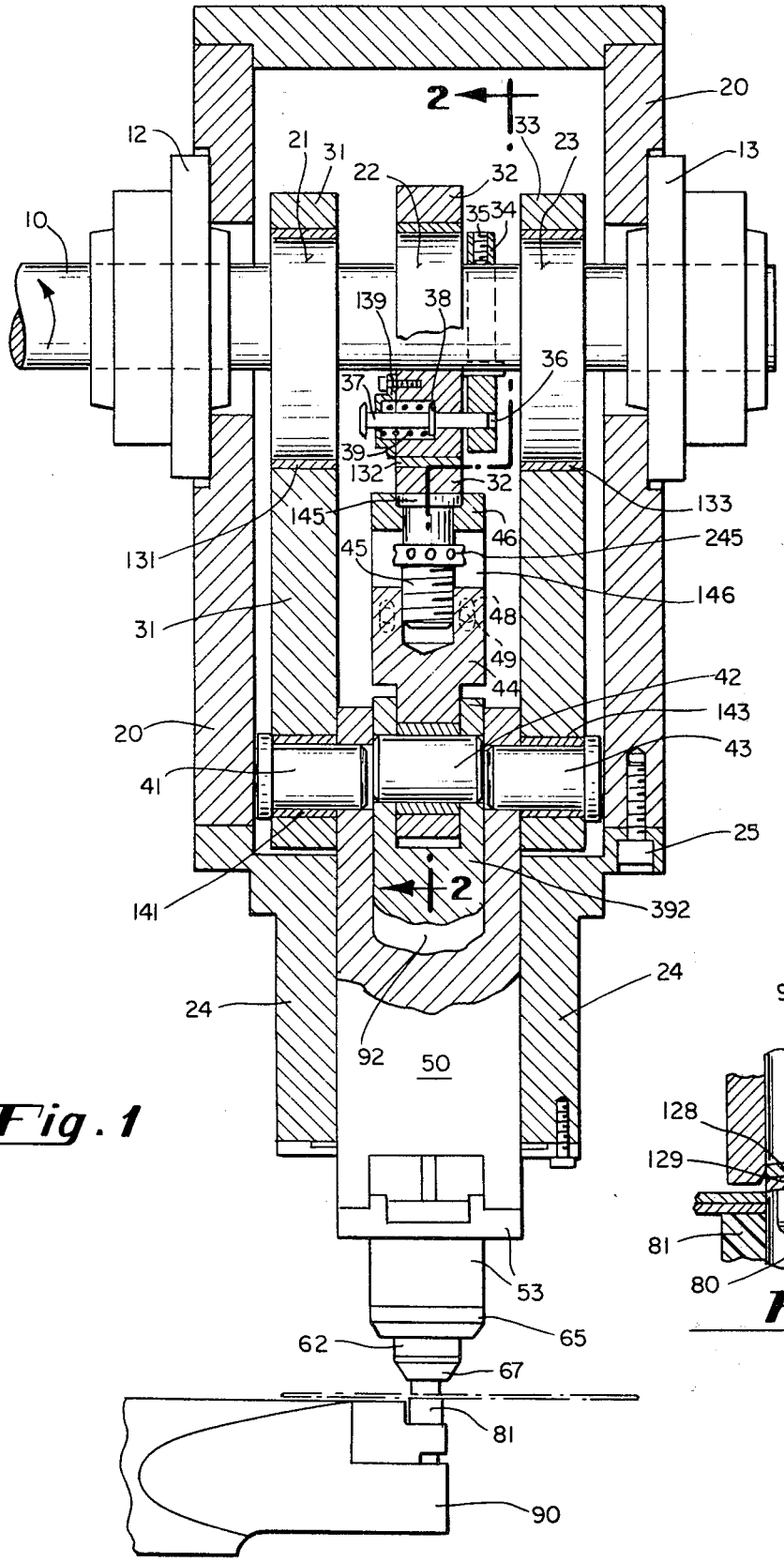
FIG. 1 is an elevational view, largely in section, of the head portion of a fastening machine generally suitable for use in practicing the present invention.

Referring now to FIG. 1, a crank shaft 10, which is driven rotationally by means not shown, has at its forward end a pair of spaced-apart sheet blocks 12 and 13 which are supported by a crank housing 20.

Supported on crank shaft 10, within the housing 20, are three eccentric discs 21, 22 and 23. The two outside discs 21 and 23 are keyed to the crank shaft. The holes of the two outside eccentric discs 21 and 23 are identically positioned and hence these two outside eccentrics move in timed coincidence with each other. The center eccentric 22 is supported free on shaft 10 and, by means to be described, is maintained in out-of-phase relation with the two outside eccentrics. This phase relationship is adjustable by a phase selector drive plate 34. In a typical case, for a particular metal thickness, the center eccentric may, for example, have a delay angle of the order of 37°.

As clearly seen in FIGS. 1 and 2, the angular position of the center eccentric disc 22 is determined and controlled by the phase selector drive plate 34 which is fixed to crank shaft 10, as by set screw 35 and key in keyway. Plate 34 is provided with a series of holes 36 for receiving selectively a pin 37 which extends through a hole in eccentric disc 22 and is spring-loaded by a spring 39 which thrusts against a flange 38 on the pin. It will be seen that by withdrawing pin 39 from the plate 34, moving the disc 22 angularly, and then reinserting the drive pin 39 in a different hole 36, the angular position, and hence the phase relationship, of the center eccentric disc 22 may be adjustable relative to the two outside discs 21 and 23. Spring 39 is retained by retainer 139.

The three eccentric discs 21, 22 and 23 carry, respectively, cranks 31, 32 and 33, suitably supported on bushings 131, 132, 133. In FIG. 1, the outside eccentric discs 21 and 23 are illustrated in such position that the outside cranks 31 and 33 are at the bottom of their downward strokes. At this same instant, the center eccentric disc 22 is in the position shown in FIG. 2. As seen in FIG. 2, the center crank 32 has started its downward descent, but will not reach its downward limit for another 37°.

The two outside cranks 31 and 33 each carries at its lower end a stub-shaft, 41 and 43, respectively, suitably journalled in bushings 141 and 143. The inward ends of the stub shafts 41 and 43 project into opposing holes in the walls of a hollow rectangular ram or slide 50 which is slidable up and down within, and is guided by, the hollow rectangular lower guide portion 24 of the housing 20. Guide portion 24 is secured to the upper portion of the housing, as by bolts and dowels 25.

Referring now to FIG. 3, bolted as by bolts and dowels 52 to the lower end of the rectangular slide or ram 50, and carried thereby, is a hollow neck portion 53 the upper neck of which adapts to the rectangular opening between rams 50 and the lower portion of which is round having a central bore into which a cylindrical screw and die holder 60 is inserted.

The upper end portion of neck portion 53 has a recess 54 into which is inserted a nut 55 which is non-rotatable in the neck 53. The non-rotatable nut 55 is provided with fine threads 58 which receive the fine threaded upper end portion 61 of the die holder 60. The lower end 62 of die holder 60 has an enlarged diameter and is externally threaded at 63 with threads which are must larger than the fine threads of the upper end portion 61. An internally-threaded clamping ring 65 is screwed onto the external threads 63 and tightened aginst the end surface 57 of the neck 53.

The enlarged-diameter lower end portion of the die holder 60 has a recess which receives the upper end portion of a hollow cylindrical cutting-and-forming die 70. The lower end portion 71 of the cutting-and-forming die 70 is of reduced diameter forming, at the junction with the upper end portion, a shoulder 72. A lock cap 67 is fitted over the reduced-diameter portion 71 of die 70 and abuts against the shoulder 72 of the die 70. Cap 67 is secured, as by bolts 66, to the end surface of the die holder 60.

The cylindrical cutting-and-forming die 70 has cutting edges and recessed portions which function as the forming portions. The die 70 may correspond to that disclosed and illustrated in FIG. 9 of my U.S. Pat. No. 3,726,000.

Positioned below the cutting-and-forming die 70 in the base 90 of the press is a pierce-and-forming punch 80. The pierce-and-forming punch 80 has cutting edges for piercing, and recessed portions for forming. The punch 80 may correspond to the punch described in my U.S. Pat. No. 3,726,000, and may be axially adjustable as there shown. Surrounding the pierce-and-forming punch 80 is a stripper or spring member 81 which may preferably be formed of urethane material.

Positioned within the aligned bores of the die holder 60 and die 70 is the elongated shank of a flattening punch 92. As seen in FIGS. 1–3, flattening punch 92 is supported by a punch holder 292 fastened to a center ram or slide 392 which is carried by pin 42 and adjustable member 44. Adjustable member 44 is supported adjustably by a bolt 45 which in turn is supported by a plate 46 secured, as by screws 47 (FIG. 2) to the underside of center crank 32. Plate 46 has a depending portion 146 having therein a pair of slots 48 which receive screws 49. In this way, the member 44 is supported against rotation. Bolt 45 has an enlarged portion head 145 which is supported in a recess in plate 46. Bolt 45 also has an integral enlarged round portion 245 with holes for pin which maybe engaged, as by a pin wrench, to turn bolt 45 to raise or lower member 44, thereby to adjust the position of the head 192 of flattening punch 92 relative to the pierce-and-forming punch 80. To make this adjustment, it is, of course, necessary to loosen the screws 49.

To adjust the position of the cutting-and-forming die 70 relative to the fixed pierce-and-forming punch 80, the operator manually unscrews clamping ring 65 and then manually grasps and moves die holder 60 in one rotational direction or the other. Since nut 55 is nonrotatable in the recess 54 in neck 53, when the die holder 60 is manually rotated, it turns on threads 58 and is therefore moved adjustably upwardly or downwardly in neck 53, according to the direction in which holder 60 is rotated. When holder 60 is so adjusted upwardly or downwardly, the cutting-and-forming die 70 is moved adjustably in corresponding manner since it is carried by the holder 60. And, since threads 58 are fine threads, fine and accurate adjustment may be made of the position of the cutting-and-forming die 70.

After the fine adjustment just described has been made, clamping ring 65 is replaced and tightened. The threads 63 of clamping ring 65 and of the lower enlarged portionn 62 of the die holder 60 are large and heavy in comparison with the fine threads at the upper end of the die holder 60. Thus, when the cutting-and-forming die 70 is lowered by its slide ram 50 to pierce and form the overlying metal sheets, the reactive load or thrust is upward through the heavy threads 63. The thrust path may be traced from the cutting-and-forming die 70 through shoulder 68 of die holder 60, holder 60, the large heavy threads 63, the clamping ring 65, the abutting end surface 57 of neck portion 53, the rectangular slide ram 50, stub shafts 41 and 43 and their associated bushings 141 and 143, and cranks 31 and 33 and their associated bushings 131 and 133. It is to be noted that this upward thrust or load during the cutting and forming operation is not placed on the fine threads 58 which are employed for adjusting of the cutting and forming die 70.

As already indicated, adjusting of flattening punch 92, relative to the fixed pierce-and-forming punch 80, is made by loosening screws 49 (to allow them to move up or down in the slots 48) and then rotating the threaded bolt 45 in the member 44. This is done by inserting a pin in a hole of enlarged portion 245 and rotating the part.

At a section 4—4 of FIG. 3, the flattening punch 92 may have a shape such as is shown in FIG. 4. To maintain proper orientation between the flattening punch 92 and the annular terminal end of the cylindrical cutting-and-forming die 70, the outer surface of the shank of the flattening punch 92 and the inner wall of the hollow cylindrical cutting-and-forming die 70 may each be provided with flats (flat surfaces). These flats are clearly seen in FIG. 4, which is a view taken along the line 4—4 of FIG. 3. The flattening punch 92 is maintained in its proper oriented position by punch holder 292 which is secured to the center ram 392.

The fixed pierce-and-forming punch 80 in the base 90 of the machine is supported in a punch holder 180 which as a flat 181. The flat on the punch 80 is oriented to correspond with the flat 181 on the punch holder 180.

Figure 5:
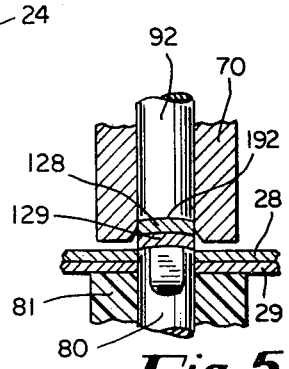
FIG. 5 is an enlarged illustration showing that the lower sheet of the displaced minor area is uncovered by the die at the instant the downwardly-moving flattening punch engages the upper displaced minor area, thereby to spread the displaced minor area of the lower sheet.

FIG. 5 illustrates a preferred manner of operation. FIG. 5 shows two overlying sheets 28 and 29 at a time instant in the operating cycle of the fastening machine just after the minor areas 128 and 129 have been displaced by the downwardly-moving cylindrical cutting-and-forming die 70 in cooperation with the fixed pierce-and-forming punch 80. In FIG. 5, the cylindrical cutting-and-forming die 70 is now rising and flattening punch 92 is moving downwardly. The end face 192 of the downwardly-moving flattening punch 92 has just engaged the upper surface of the displaced minor area 128 of the upper sheet. At this instant, the upwardly-moving cylindrical die 70 has just cleared the displaced minor area 129 of the lower sheet. The minor area 128 of the upper sheet is still encased. This represents a desirable timing relationship. It allows the flattening punch 92 to transmit its energy through the still-encased displaced minor area 128 of the upper sheet to the displaced minor area 129 of the lower sheet to spread trhe lower minor area 129 over the upper sheet 28.

One means for achieving the desirable timing relationship just described between the cylindrical cutting-and-forming die 70 and the flattening punch 92 is illustrated in FIGS. 1 and 2, and has already been briefly described hereinbefore. It will be seen that the phase relationship between the flattening punch 92 and the cylindrical die 70 is adjustable by means of the phase selector drive plate 34. To adjust the phase relationship, the drive pin 37 is pulled out of the hole 36 in which it had been positioned, the freely-mounted disc 22 is rotated adjustably on the shaft 10, and the drive pin 37 is reinserted in a different hole 36 of the series of holes provided in the phase selector drive plate 34. The phase adjustment allows the desirable timing relationship described above, and illustrated in FIG. 5, to be maintained for different thicknesses of sheets.

As has already been indicated, the relationship between the pierce-and-forming punch 80 in the base of the machine and the flattening punch 92 may be adjusted for different thicknesses of sheets, and/or for wear, either by adjusting the flattening punch 92 as described in the present application or by adjusting the base punch 80 as described in my earlier-filed application. In either case, adjustment of the phase relationship between the flattening punch 92 and the cylindrical die 70, as by means such as have been described herein, is desireble in order to achieve the advantageous timing relationship illustrated in FIG. 5 and described above.

Figure 7:
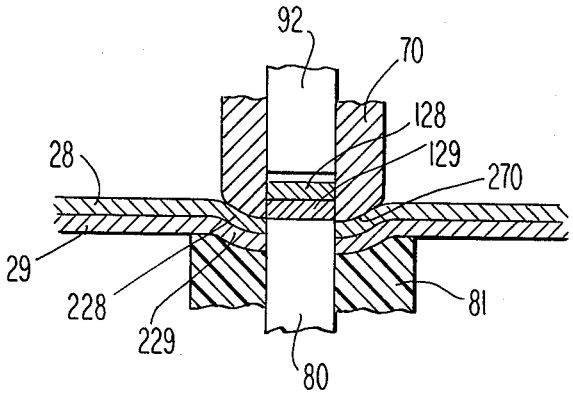
FIG. 7 is a view, in section, generally similar to FIG. 5 but showing the use of a cylindrical die shaped to bend down the edge portions of the major areas immediately adjacent the discontinuous slits defining the minor areas.

While FIG. 5 illustrates a preferred mode of operation, there may be instances in which it is necessary or desirable to reduce the extend to which the displaced minor-areas 128 and 129 project above the plane of the non-displaced major-areas of sheet 28 and 29. In such instances, the cylindrical die 70 may be provided with an end face 270 shaped as illustrated in FIG. 7 so that during the pierce-and-punch portion of the cycle, the edge portions 228 and 229 of the major-areas of sheets 28 and 29 are bent downwardly immediately adjacent the slits or piercings. The stroke of the cylindrical die 70 is so adjusted that the minor-areas 28, 29 are displaced to a position just above the bent-down edge portions 228, 229.

Figure 8:
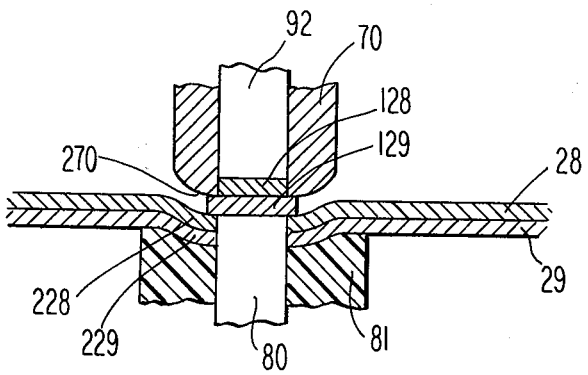
FIG. 8 is a view, in section, similar to FIG. 7 but showing the instant in the operational cycle when the cylindrical die has been raised above the displaced minor area of the lower sheet and the flattening punch has engaged the displaced minor area of the upper sheet to spread outwardly the displaced minor area of the lower sheet over the bent-down edge portions.

FIG. 8 illustrates the instant in the operating cycle when the cylindrical die 70 is rising and has just cleared the displaced minor area 129 of the lower sheet. The downwardly-moving flattening punch 92 has engaged the displaced minor-area 128 of the upper sheet which is still confined within the cylindrical die 70. The energy involved in the downward force of flattening punch 92 on the confined upper area 128 has been transmitted to the displaced lower minor-area 129 and as a result, the displaced minor-area 129 of the lower sheet has spread outwardly over the upper surface of the bent-down edge portion 228 of the upper sheet.

It will be seen from FIG. 8 that the extent to which the displaced minor-areas extend above or beyond the plane of the non-displaced sheets 28, 29 has been reduced relative to that illustrated in FIG. 5. And as previously indicated, reducing the extent to which the displaced minor-areas extend above or beyond the planes of the sheets 28, 29 may be necessary or desirable in instances where space limitations are involved.

What is claimed is:

1. A method of locking together overlying sheets of metal or other material having deformable properties and including first and second sheets having interior and opposed exterior surfaces; said method comprising:

a. piercing said overlying sheets discontinuously along a boundary line defining a minor area;

b. displacing in one direction the material of said first and second sheets within said minor area out of the respective planes of the non-displaced first and second sheet major-area sheet material and bending in the opposite direction the edge portions of the major-area sheet material adjacent the piercings therein, the extend of said displacement of said minor-area material being such that the exterior surface of the minor-area material of the first sheet is just beyond the exterior surface of the bent edge portion of the second sheet material; and c. compressing together the displaced minor-area material of said first and second sheets while confining the displaced minor-area material of the second sheet to limit its outward spread and to spread outwardly the displaced minor-area material of the first sheet over the exterior surface of the bent edge portion of the second sheet material beyond the edges of the piercings therein.

2. Apparatus for locking together overlying sheets of metal or other material having deformable properties and including first and second sheets having interior and opposed exterior surfaces; and apparatus comprising:

a. means for piercing said overlying sheets discontinuosuly along a boundary line defining a minor area;

b. means for displacing in one direction the material of said first and second sheets within said minor area out of the respective planes of the non-displaced first and second sheet major-area sheet material and for bending in the opposite direction the edge portions of the major-area sheet material adjacent the piercings therein, the extent of said displacement of said minor-area material being such that the exterior surface of the minor-area material of the first sheet is just beyond the exterior surface of the bent edge portion of the second sheet material; and c. means for compressing together the displaced minor-area material of said first and second sheets while confining the displaced minor-area material of the second sheet to limit its outward spread and to spread outwardly the displaced minor-area material of the first sheet over the exterior surface of the bent edge portion of the second sheet material beyond the edges of the piercings therein.

* * * * *